United States Patent [19]

Broome

[11] 4,158,252

[45] Jun. 19, 1979

[54] TENTER CLIP

[75] Inventor: Jack Broome, Concord, N.C.

[73] Assignee: Crompton & Knowles Corporation, New York, N.Y.

[21] Appl. No.: 902,517

[22] Filed: May 3, 1978

[51] Int. Cl.[2] ..... D06C 3/04

[52] U.S. Cl. ..... 26/93

[58] Field of Search ..... 26/93, 94, 95, 96

[56] References Cited

U.S. PATENT DOCUMENTS

| | | | |
|---|---|---|---|
| 2,178,892 | 11/1939 | MacKnight | 26/93 |
| 3,058,191 | 10/1962 | Nash | 26/93 |
| 3,199,165 | 8/1965 | Hyatt | 26/93 |
| 3,234,621 | 2/1966 | Hyatt | 26/93 |

*Primary Examiner*—Robert Mackey

[57] ABSTRACT

A tenter clip comprising a material gripping element and a base element which are connected to each other by screw means and the gripping element is held in proper alignment with the base element by means of pintles which serve the dual function of connecting the base element to adjacent links of the tenter chain and also for maintaining the gripper element in proper alignment with said base element.

4 Claims, 6 Drawing Figures

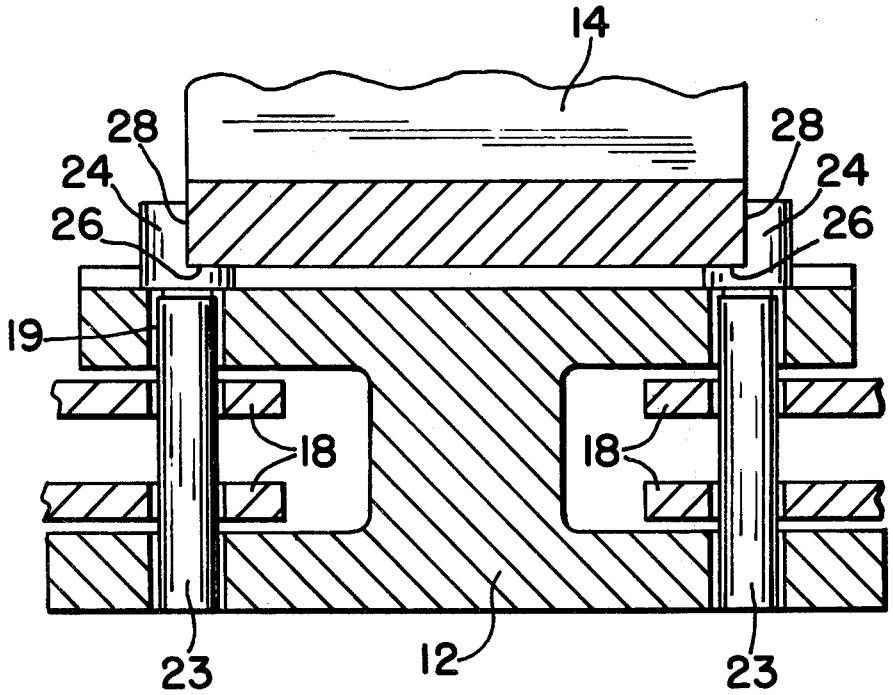

TENTER CLIP

BACKGROUND OF THE INVENTION

This invention relates to tenter clips, and more particularly, to tenter clips having a gripper element and a base element which are held together by screw means and held in proper alignment one with the other by means of pintles which also connect the base element to adjacent links of a tenter chain.

A tenter chain runs around sprockets located at a considerable distance from one another on the frame of a tentering machine. Between the sprockets, the chain travels along an extended rail. There are two sets of rails, sprockets, and chains on each tenter frame. The material being processed on said tenter is gripped along its opposite edges by the tenter clip gates and it is gradually stretched sidewise as the rails diverge towards the discharge end. It is highly important that the gates, as a whole, be maintained in substantial alignment as they move the material in order that their pull on the material shall be as nearly uniform as possible. To this end, the tenter clips of the prior art have been provided with surfaces for engaging the rails of the tenter frame. These include one surface or face for riding along the outside surface of the tenter rail and another surface for riding along the top of the tenter rail.

Tenter clips commonly include a base element and a gripper element, and the surface for riding along the outside of the tenter rails normally is on the base element whereas the surface for riding along the top of the tenter rail is usually on the bottom of the gripper element. In order to maintain proper alignment or orientation of the gates, it is important that the gripper element be maintained in proper alignment with the base element.

Tenter clips manufactured by the Marshall & Williams Corporation, of Providence, Rhode Island, have maintained this alignment in the past by providing the gripper element with a downwardly extending surface which contacts a portion of the rail engaging face. This downward extending surface also contains the surface that rides along the rail of the tenter frame. Thus, this downwardly extending surface, which engages the rail contacting face of the tenter clip base element, is held in alignment by means of a screw or bolt which holds the base element and the gripper element together, and on new chains this works very well. However, during use of the chain the bottom surface of this extension rides along the top of the guide rail of the tenter frame. This results in considerable wear on this surface and after relatively short usage this surface is eroded to the extent that it no longer maintains the gripping element in proper alignment with the base element. When this happens, the gripping element must be replaced at considerable cost. Tenter clips of the prior art are shown in FIGS. 2 and 3 of the drawings and will be described in more detail in describing said drawings.

Tenter clips and tenter clip chains are shown in more detail in U.S. Pat. No. 2,178,892 which issued on Nov. 7, 1939 to H. A. MacKnight; U.S. Pat. No. 3,058,191 which issued on Oct. 16, 1962 to J. C. Nash; and U.S. Pat. No. 3,199,165 which issued on Aug. 10, 1965 to F. Hyatt.

SUMMARY OF THE INVENTION

The present invention comprises a tenter clip which has a base element and a gripping element which engages, and is supported by, the base element. The gripping element is held in proper alignment with the base element by means of pintles which serves the dual function of linking the base element to adjacent links of the tenter chain and also having a head portion, a portion of which extends beneath the lower surface of the gripper element and another portion which extends vertically along the sides of the gripper element so as to maintain said element in proper alignment with the base element when the gripper element is held in place on the base element by means of a screw or bolt. In the present invention, the pintles are provided with a head which is generally cylindrical but has approximately half of it cut away in order to form a first surface for extending beneath the bottom surface of the gripper element and having a second vertical surface which extends along the side of the gripper element. Two of such pintles are provided so that the gripper element is held in place when it is bolted to the base element.

BRIEF DESCRIPTION OF THE DRAWINGS

The invention will now be described, by way of example, with reference to the accompanying partly diagramatic drawings in which.

DETAIL DESCRIPTION OF THE DRAWINGS

Figure 1:
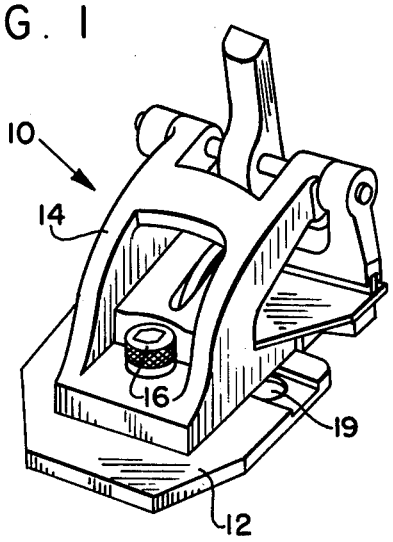
FIG. 1 is a perspective view of the tenter clip of the invention with the pintles removed.
Figure 6:
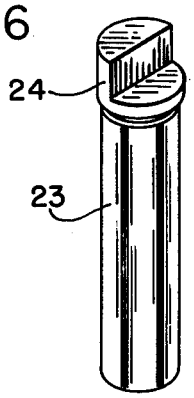
FIG. 6 is a perspective view of the pintles of the invention.
Figure 2:
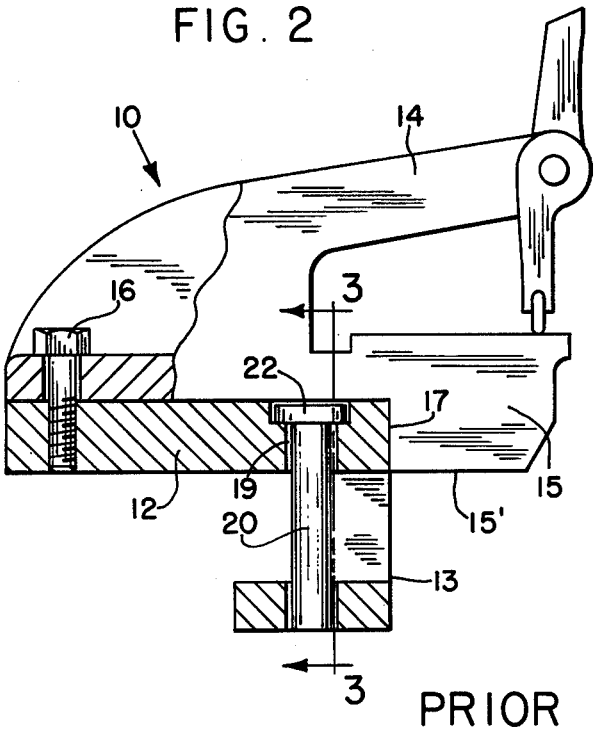
FIG. 2 is a side view of the tenter clip of the prior art with some parts shown in section or partial section for sake of clarity.
Figure 3:
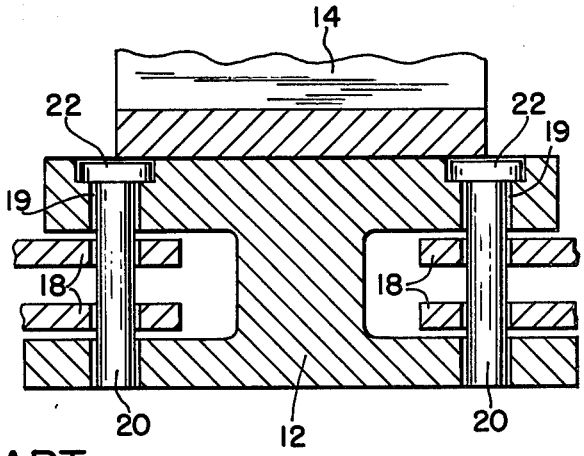
FIG. 3 is a front view of the tenter clip of the prior art shown in FIG. 2 taken along line 3—3 of FIG. 2.
Figure 4:
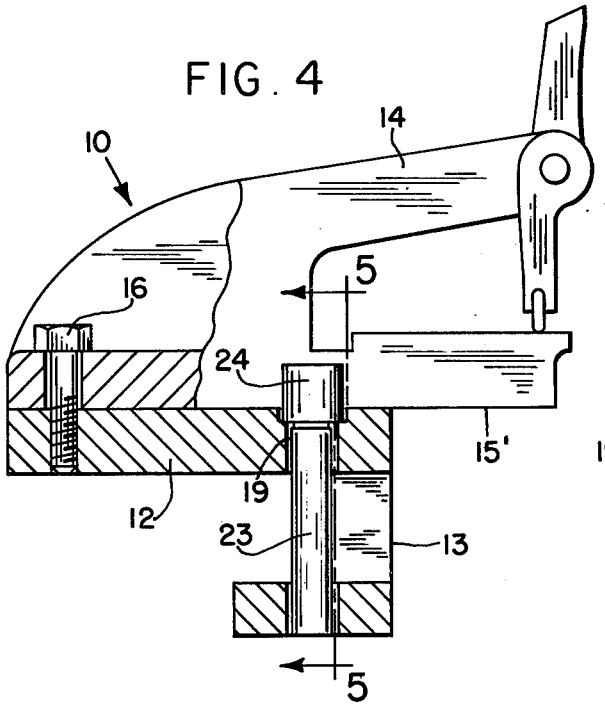
PRIOR ART FIG. 4
FIG. 4 is a side view of the invention similar to that shown in FIG. 2 with some parts shown in section or broken away for sake of clarity.

Referring now to FIGS. 2 and 3 of the drawings, which illustrate the prior art tenter clip, and are shown to contrast the prior art tenter clip with that of the invention. In FIGS. 2 and 3, it will be seen that tenter clip 10 comprises a base element 12 and a gripping element 14. Base element 12 has a rail engaging face 13 with openings 19 through which a pair of link pins 20 extend. Pins 20, in this prior art device, serve only to link or connect base element 12 to adjacent chain links 18 of the tenter chain and has a head 22 which keeps the pin from dropping through opening 19.

Gripper element 14 rests upon, and is supported by, base element 12 and has the normal fabric gripping elements, which are not described in detail here since they form no part of the present invention. Gripper element 14 has a downwardly projecting extension 15 which is provided with a surface 17 which in turn engages the upper portion of the rail engaging face 13 of the base element so as to maintain the gripper element in proper alignment with the base element when machine screw or bolt 16 connects the two.

When this tenter clip is new, there is no problem in maintaining the gripper element in proper alignment with base element 12. However, during use surface 15' engages the stationery guide rails of the tenter frame and this results in considerable wear on surface 15'. As this surface becomes eroded, it becomes more and more difficult to maintain the gripper element 14 in proper alignment with base element 12. After enough of surface 15' has been eroded, then gripper element 14 tends to pivot about bolt 16 and causes improper stretching of the material. When this happens the entire gripper element must be replaced.

Figure 5:
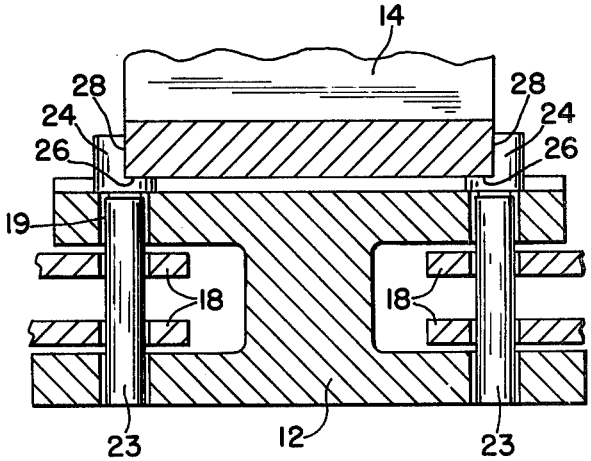
FIG. 5 is a front sectional view of the tenter clip of the invention taken along line 5—5 of FIG. 4.

Referring now to FIGS. 1, 4, 5, and 6, it will be seen that the basic elements of the tenter clip of the invention are substantially the same as those of the prior art device. However, extension surfaces 15 are of the prior art device can be entirely eliminated, if desired, since this extension is not depended upon to maintain proper alignment of the gripper element with the base element. This alignment is maintained by means of an improved pintle 23 which serves the dual function of linking the base element to adjacent chain links 18 while also maintaining the gripper element in proper alignment. This is permitted by the unique shape of head 24 of pintle 23, which is shown in perspective in FIG. 6 of the drawings. This configuration, in operation, can best be seen in FIG. 5 of the drawings. Head 24 is provided with a horizontal surface 26 which extends beneath the bottom surface of the gripper element so that the pintles are held in place by the gripper element 14 when the tenter clip is assembled. Pintle head 24 has another surface 28 which extends in the vertical plane as shown in FIG. 5 along the side of gripper element 14 so that when gripper element 14 is held in place by machine screw or bolt 16, it will be maintained in proper alignment regardless of how much surface 15' may have eroded due to wear and tear during use of the tenter chain.

While head 24 of pintle 23 is illustrated as cylindrical this is only for purposes of illustration and obviously any configuration which would provide for surfaces 26 and 28 could be used in invention. Furthermore, it is obvious that the tenter clip of the invention could be used for stretching either fabric, film, paper or any other material generally handled by tenters.

I claim :

1. A tenter clip comprising:

(A) a material gripping element comprising:

(1) means for gripping material; and a portion for engaging the guide rail of a tenter;

(B) a base element comprising:

(1) an upper surface for engaging a portion of the bottom surface of the material gripping element;

(2) a guide face which lies in a plane at an angle from the upper surface for engaging the guide rail of a tenter; and (3) projections extending from opposite ends of said base element and having openings therein for connection to adjacent links of a tenter chain;

(C) screw means for connecting the material gripping element to the base element; and (D) pintle means, each of which, comprising:

(1) a portion for extending through the openings in the projections of said base element and through openings in adjacent chain links for connecting the base element to said adjacent links;

(2) a head portion which comprises:

(a) a first surface which extends between the gripping element and the base element when the base element is connected to the gripping element; and (b) a second surface which extends in a plane at a right angle to said first surface, along one side of said gripping element when the gripping element is connected to said base element; whereby said pintles, in cooperation with said screw means, maintain said gripping element in proper alignment with said base element and also connects said base element to adjacent links of a tenter chain.

2. A tenter clip as set forth in claim 1 wherein the bottom surface of the material gripping element which engages the guide rail of a tenter lies in the same plane as does the portion of the bottom surface which is engaged and supported by the base element.

3. A tenter clip as set forth in claim 1 wherein the portion of the pintle which extends through the openings in the projections of the base element is cylindrical.

4. A tenter clip as set forth in claim 1 wherein the head portion of said pintle is cylindrical at the point of where said first surface extends between the gripping element and the base element.

* * * * *